United States Patent [19]

Satterthwaite

[11] Patent Number: 4,603,853

[45] Date of Patent: Aug. 5, 1986

[54] MODULAR FRAME STRUCTURE AND BUILDING SYSTEM

[76] Inventor: Edward W. Satterthwaite, 2107 Spruce St., Philadelphia, Pa. 19103

[21] Appl. No.: 526,643

[22] Filed: Aug. 26, 1983

[51] Int. Cl.[4] ..... A63B 9/00

[52] U.S. Cl. ..... 272/113; 52/81; 52/648; 52/DIG. 10; D25/4

[58] Field of Search ..... 272/113; 446/123, 487; 52/236.1, DIG. 10, 245, 81; 403/361, 388; D21/108, 245; D25/4, 13; 135/100

[56] References Cited

U.S. PATENT DOCUMENTS

| | | | |
|---|---|---|---|
| 2,810,233 | 10/1957 | Jakobsen | 446/126 |
| 3,339,920 | 9/1967 | Moritz | 272/113 |
| 3,733,762 | 5/1973 | Pardo | 52/236.1 |
| 3,974,600 | 8/1976 | Pearce | D25/4 |
| 4,097,043 | 6/1978 | Rudy | 52/DIG. 10 |
| 4,129,975 | 12/1978 | Gabriel | 446/126 |
| 4,308,698 | 1/1982 | Fleishman | 52/81 |
| 4,309,852 | 1/1982 | Stolpin | 52/81 |
| 4,446,666 | 5/1984 | Gilman | 52/648 |

*Primary Examiner*—Richard J. Apley
*Assistant Examiner*—S. R. Crow
*Attorney, Agent, or Firm*—Steele, Gould & Fried

[57] ABSTRACT

A system of interconnectable modular frame components for construction toys, playground climbing equipment and the like is based upon tubular triangular leg elements joined at about fifty-four degrees, forty-four minutes and seventy degrees, thirty-two minutes, being thereby modularly stackable at specific useful orientations. Complete triangular wall elements are joined with other complete triangular wall elements, forming tetrahedral modules which are then combined with other such modules by transverse attachment of the tubular legs of each said module, the tubular legs being coextensive structural elements in structures built from attached modules.

14 Claims, 8 Drawing Figures

FIG. 5
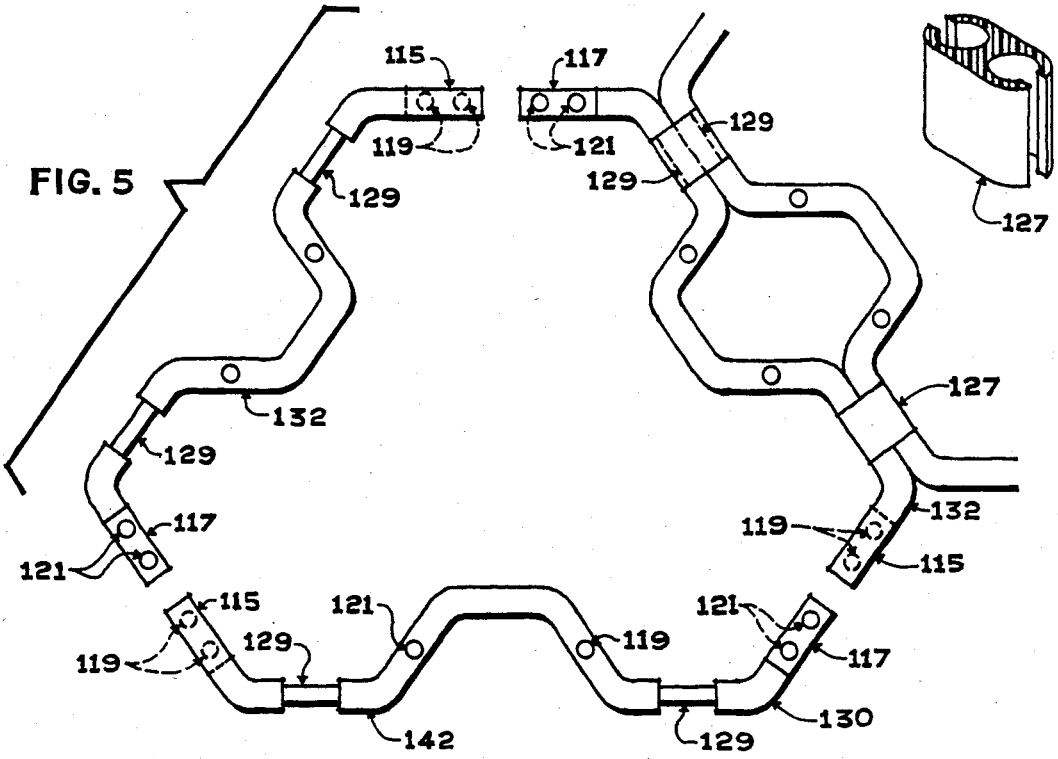
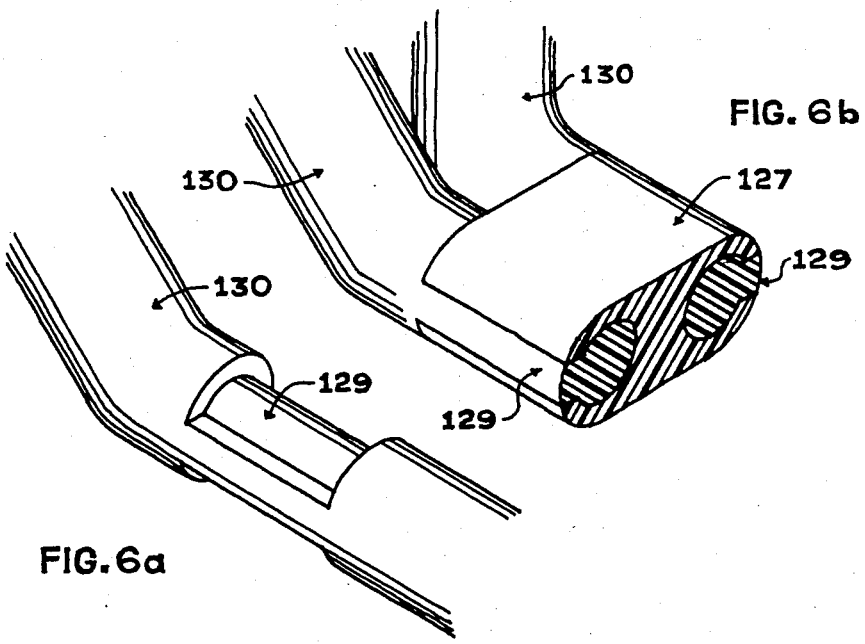
FIG. 6b
FIG. 6a

MODULAR FRAME STRUCTURE AND BUILDING SYSTEM

BACKGROUND OF THE INVENTION

1. Field of the Invention

This invention concerns the field of modular stackable elements formed from tubes, and in particular to such elements employed in large scale playground climbing equipment and small-scale building toys.

2. Description of the Prior Art

Various modular structures for use as playground equipment, toys and the like are known in the art. U.S. Pat. No. 3,974,611 to the present applicant concerns a modular building system based upon a module having triangular faces with internal angles of fifty-five degrees, thirty-five degrees and ninety degrees, and, forty-five degrees, forty-five degrees and ninety degrees. Such modular bodies are useful to stack upwards and outwards. Unlike building systems based upon regular polyhedrons, which build outwards from limited angles, such a system generates frequent regular reoccurring vertical and horizontal surfaces which are useful for building structures. The system of the aforesaid prior patent was based upon polyhedral modules in which each side was formed of sheet material, and various secondary modules were generated from the basic module for certain building needs.

Regarding structures built of sheet materials, a variety of regular polyhedral devices have been patented by Dattner, including U.S. Pat. No. 3,632,109 and others. In order to provide sufficient means for a climber to pass through the internal chambers defined by the polyhedrons of Dattner's design, tubular connecting passageways are required. In any event, even if stacked on facing surfaces, Dattner's modules would not build conveniently into an open-work structure having the maximum of useful vertical and horizontal repeating surfaces.

Various climbing toys for playgrounds and construction toys are based upon tubular elements connected into geometric structures. U.S. Pat. No. 3,974,600—Pearce concerns a building unit, including truncated regular polyhedral modules. The hope of such devices is to form expandable maximum-diversity building systems using tubular subcomponents. Almost invariably, however, such devices are based upon the connection of a plurality of tubular members at a single point or vertex. That is, various tubes radiate from single connection members. In this respect, the basic module of such devices is the single tubular leg, and not a module formed therefrom. Each tubular leg may be considered a part of any of the contiguous surrounding polyhedrons. As a result of such construction, climbing toys and building sets are based upon the strength of individual tubular connections, the connections being at either end of each tube, and not upon the structural integrity of a plurality of modules, each of which is structurally sound of its own construction.

In two dimensions, U.S. Pat. No. 4,219,958—Shulyak is based upon structurally-complete triangles, pivotally attached along co-extensive legs of the triangles. The device employs the structural integrity of individual triangles to form three-dimensional structures which may be varied by altering the hingeable connections. Two-dimensional triangular modules form three-dimensional structures due to frictional pivoting attachments. While such a device is suitable for a toy, it will be appreciated that there is insufficient structural integrity in the structures so formed. The device is therefore not suitable for a playground climbing toy or an expandable building block system.

The present invention only superficially resembles expandable tubular building structures as known in the art. Unlike devices in the art, the invention concerns attaching structurally-complete triangles to form structurally-complete modules, and attaching the modules into various structures. By virtue of the selected angles and truncations, the tubular structure is expandable with great versatility, but is based upon frequently-recurring useful surfaces and building angles.

An intermediate indentation formed in each leg of each triangle can be used as a convenient attachment point for one or more safety and decorative platform members used to close selected triangles of the device. These indentations also provide numerous hand-holds and foot rests which permit a climber to move easily through a structure having openings somewhat larger than that completely spanned by a single step. Accordingly, the invention is both structurally more sound and more easily and safely climbed than structures known in the art.

Interconnection of the rods or tubes forming legs of the triangles may be accomplished in several primarily end-to-end arrangements. The remaining connections involve face-to-face coextensive connections such as the attachment of parallel tubes to join triangles into a module and/or to join modules into a structure. The system is therefore modular in a manner that builds useful openwork structures for playground climbing apparatus and for building toys.

SUMMARY OF THE INVENTION

It is an object of the invention to produce the most versatile of building systems based upon a small number of modular parts.

It is also an object of the invention to employ the structural integrity of triangles and modules based upon triangles to the maximum benefit in a building block and playground climbing apparatus.

It is another object of the invention to produce a safe and attractive playground device and building toy which, although based upon a small number of parts, is both optically and physically complex and interesting for climbers and builders.

These and other objects are accomplished by a system of interconnectable modular frame components for construction toys, playground climbing equipment and the like, based upon tubular triangular leg elements joined at about fifty-four degrees, forty-four minutes and seventy degrees, thirty-two minutes, being thereby modularly stackable at useful orientations. Complete triangular wall elements are joined with other complete triangular wall elements, forming tetrahedral and polyhedral modules which are then combined by transverse attachment of coextensive tubular legs, as opposed to attachments at vertices.

BRIEF DESCRIPTION OF THE DRAWINGS

There are shown in the drawings the embodiments which are presently preferred. It should be understood, however, that the invention is not limited to the precise arrangements and intrumentalities shown in the drawings, wherein:

FIG. 5 is a partial exploded elevation view of an alternative embodiment, adapted for use as a building toy element.

FIGS. 6*a* and 6*b* are partial perspective views of the leg connection of the embodiment of FIG. 5.

DETAILED DESCRIPTION OF THE PREFERRED EMBODIMENTS

Figure 1:
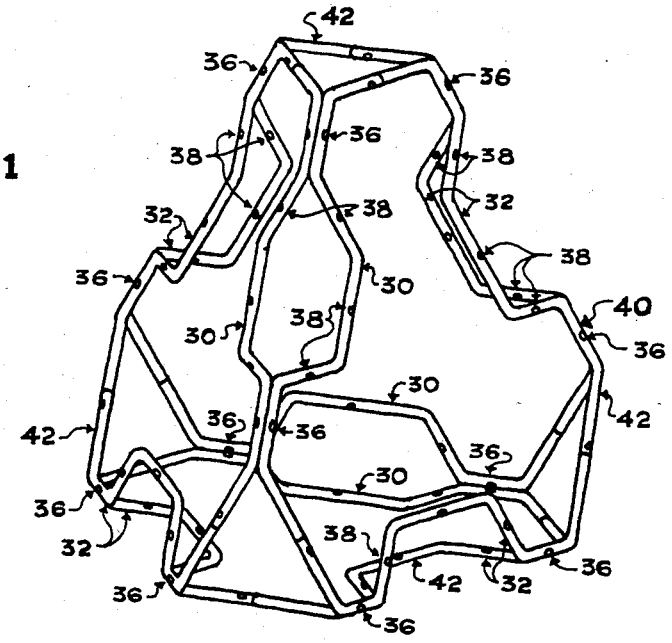
FIG. 1 is a perspective view of a basic polyhedral module according to the invention.
Figure 2:
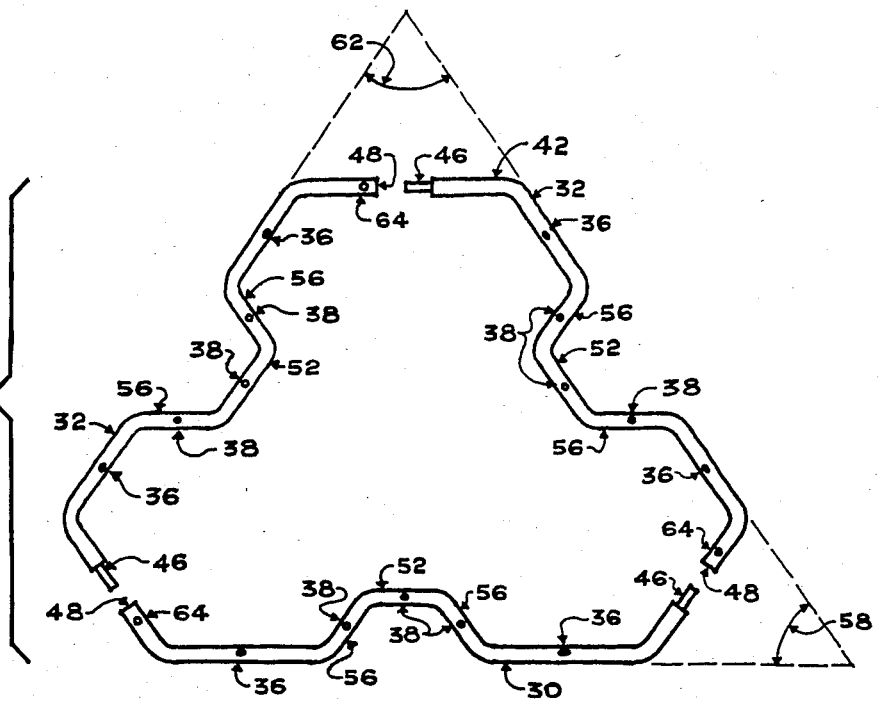
FIG. 2 is an exploded plan view of a single triangular face of the module of FIG. 1.

With reference to FIGS. 1 and 2, the invention is based upon relatively simple modular components. The simplest components are tubes, namely, a base leg and two standing legs, joined to form an isosceles triangle. Four triangles are connected to make a module. More specifically, a pair of triangles, attached along their base legs, are joined to a second pair of triangles also attached to one another along their base legs. The two pair of attached triangles are then joined along their standing legs such that a tetrahedral module results in which the base legs from the first and second pairs of triangles are perpendicular to one another and disposed on opposite edges of the tetrahedral module. The tetrahedral modules are attachable to one another to form structures. All the aforesaid attachments are made along coextensive tubes and every tube is one of three in a separable triangle. The attachment of complete structurally sound elements makes the device unusually strong. The addition of panels for closing openings and provision for particular hand-holds for facilitating climbing add to the usefulness and attractiveness of the device.

A basic polyhedral module 40 is shown in FIG. 1. The module comprises four base legs 30 and eight standing legs 32, that is, two standing legs for each base leg, the whole comprising four isosceles triangles. As so formed of four triangular constructions 42, module 40 is assembled by attaching the corresponding standing legs of the triangles to one another by means of bolt holes 36. Bolt holes 36 are aligned to join the corresponding legs. Since base legs join triangles at ninety degrees, bolt holes for joining base legs are aligned at forty-five degrees to the plane of the triangle. Similarly, bolt holes for joining standing legs are at sixty degrees to the plane. In order to stack or build with polyhedral modules 40, bolt holes 38, perpendicular to the plane, allow the face-to-face connection to other triangles or to panels, etc.

The basic triangular unit 42, as shown in FIG. 2, may be connected by means of swaged ends 46 and mating receptacles 48. The shape may be formed by compressing the end of the tube to reduce its diameter. Alternatively, ends 46 may be formed from dowels which are inserted into each end of abutting tubes, and attached to each end, for example, by screws in holes 64. If swaged, no two of the base leg 30 and two standing legs 32 are entirely identical because the angle between the standing legs 32 is different than the angle between either standing leg 32 and base leg 30. In particular, angle 58, at which the standing leg and base leg are joined, is equal to approximately fifty-four degrees, forty-four minutes, while the standing legs are joinable to one another at angle 62 of seventy degrees, thirty-two minutes. It will therefore be appreciated that two separate standing leg constructions (i.e., a "left" and a "right") are required in order to execute a connection by means of a swaged end and receptacle; however, a dowel-type connection allows symmetrical use of one type of standing leg.

Swaged ends 46, provided at one end of each leg, may be formed as known in the art by forming a pinched groove along a portion of the tube at the end of the leg, thereby reducing the external diameter of the tube. Upon insertion in receptacle end 48, the tubes are locked to one another, for example, by threading a bolt through the swage, or alternatively through a dowel construction, at bolt hole 64.

The basic triangle of the invention can be formed using a triangle having substantially straight legs. As shown in FIG. 2, the legs of triangle 42 are preferably bent at their ends, thereby truncating the triangle and the resulting module. These truncations result in additional faces of tetrahedral module 40, useful for mounting supporting surface members if desired, and useful as access points for climbing as well. In order to increase the availability of attachment points, hand-holds, foot rests and the like, indentations are formed in the legs of triangles 42, displaced inwards from the ends of each leg of each triangle. The central portion 52 of the indentation is disposed parallel to the respective leg. It is presently preferred, in order to provide provide a plurality of additional useful hand-holds and foot-holds, that attachment segments 56, to which indented segment 52 is attached, be provided as well, and disposed parallel the nearest attached leg. In other words, the connection segments 56 for the indentations 52 on standing legs 32, 34 are disposed either parallel to base leg 30 or opposite leg 34, 32. In this manner, regardless of the orientation of the module within the structure, some portions of the handholds and footrests are always horizontal as the modules are stacked upon one another and as the structure is extended upwards and outwards.

The dimensions of the truncations and handhold indentations are preferably chosen to result in a relatively large opening between tubes. All the openings should substantially exceed the size of a child's head or foot, for safety reasons. The size and angles of openings may also be subject to standards of the U.S. Consumer Product Safety Commission or other governmental bodies.

Figure 3:
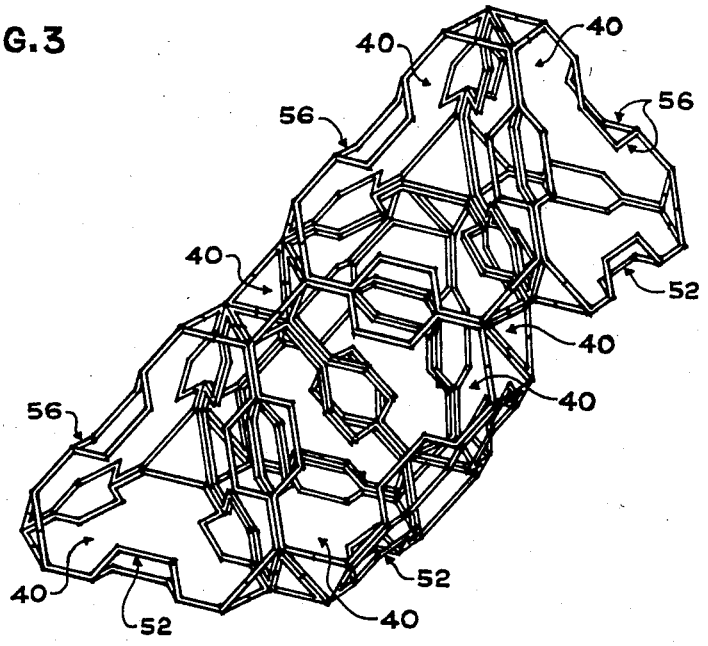
FIG. 3 is a perspective view of a simple structure based upon the modules of the invention.

A structure according to the invention is shown in perspective in FIG. 3. Based upon the visual and climbing path complexity of this structure employing approximately seven modules 40, it will be apparent that a great deal of variety will be available to any user climbing the structure. External pathways along the outside areas of the structure are only one of many possible paths. The user can also pass through various internal tunnels defined by successive triangular openings in each face of each module. All along the chosen path, handholds and footrests are provided by the triangle legs, by their truncations, by indented legs 52, and by their attaching segments 56. Moreover, at points where multiple modules are bolted together, indentations 52 extend in all available directions, resulting in additional variety and excitement.

Figure 4:
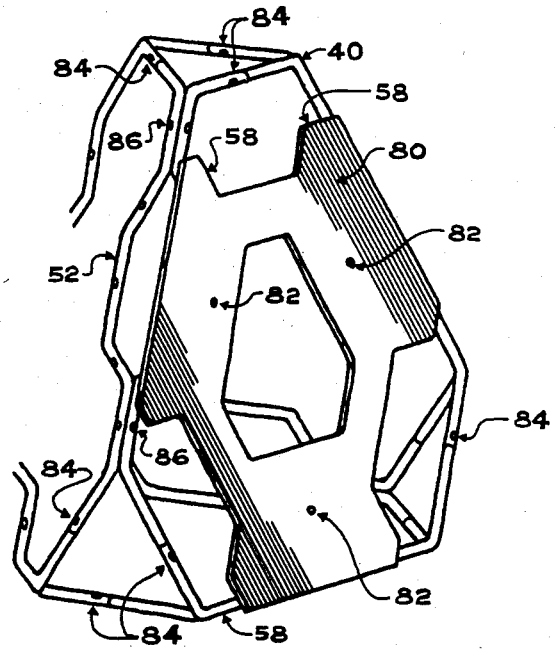
FIG. 4 is a partial view of a module of FIG. 1, showing the connection of triangular legs, panels and hand-hold indentations.

Flat panels adapted to close or partially close openings defined by triangles 42, and/or the openings defined by the truncated ends of adjoining triangular legs, are preferably dispersed throughout the structure. In FIG. 4, the particular attachment of legs and panels is shown. At random or periodic places in the structure, panels 80 may be used to close the opening of any triangle. In this manner, horizontal surfaces can be formed for use as resting points; dangers such as long vertical drops can be cordoned off; and, enclosed passageways can be defined. For reasons of safety, it is presently preferred that horizontal panels be in place at every second or third module, at portions higher than six feet in elevation, limiting a possible fall to that distance.

Panel 80 may be dimensioned to completely close a triangular face of module 40, or may only partially close the face, as in FIG. 4. While the panel 80 of FIG. 4 closes off the indentation handholds behind it, the lack of handholds can be supplied by suitably oriented openings and edges in panels 80. The various internal and external edges 58 are therefore oriented parallel to the legs of the triangle.

With reference to FIG. 4, panel 80 is shown attached to the surrounding legs by bolts 82 at their indentations 52. The bolts pass perpendicularly through the legs and through panel 80. This perpendicular passage may be contrasted with leg-to-leg bolts 86, which are aligned perpendicular to the axes of their respective tubes, but disposed at approximately sixty degrees to the plane defined by the triangle. Base-to-base interconnecting bolts are preferably disposed at forty-five degrees to the plane of the triangle. In so doing, the legs join into triangles locked at bolts 84 (at any angle), the triangles into modules at leg bolts 86, and the modules into structures at face-to-face connections of coextensive triangular faces of successive modules. The modules may be bolted together as the panels are attached, namely using bolts 82. Alternatively, or in addition, bolt holes 88 are available. Bolt connections 82, 88 are all aligned perpendicular to the plane defined by the triangle which they affix to a second triangle on a neighboring module. It will be appreciated that the preferred attachment by bolts may be replaced by other suitable connecting means. For example, rivets will provide a more permanent attachment. In a system adapted for a small-scale building toy, a resilient snap lock fit is preferred.

A number of features of the invention are likewise applicable when the scale of the module is reduced as appropriate for a construction toy. The module can be theoretically reduced over a continuous range from the full-size climbable playground apparatus to hand-held modules or tubes. It should be appreciated that the invention covers not only the preferred embodiment in which the legs of each triangle are removably attached to one another, but also an embodiment in which the smallest unit is a complete triangle of integral, permanently-attached legs. The playground apparatus can be reduced to building toy scale; and conversely, the building toy shown in FIGS. 5–7 can also be enlarged until it becomes climbable. The particular features of the preferred building toy, however, are chosen to facilitate manual attachment and disassembly, while the features of the playground climbing apparatus are adapted to maximize strength.

As shown in FIG. 5, the building toy of the invention is based upon triangular legs attached endwise to form triangles, which triangles are then attached leg-to-leg to form modules. Modules are attached by face-to-face attachment of coextensive triangles in adjoining modules, aligned in register. Like the playground climbing toy, the modules attach to build structures which extend upwards and outwards to provide surfaces at useful orientations, and not merely to extend the faces of a polygon at a limited number of orientations.

The endwise connection of legs 130, 132 may be accomplished by a swaged end fit, as accomplished with the climbing apparatus. In order to facilitate molding, however, it is presently preferred that an overlapping arrangement of extending pins and mating receptacles be provided to attach both legs 130, 132, and also to attach panels to triangles and modules to modules. Truncated ends 115, 117 are provided with mating pins 119 and receptacles 121. Alternatively, each end can be provided with one pin and one receptacle. Protruding pins and mating receptacles are also used to make face-to-face attachments of triangular elements 142.

A special, easily-installed and easily-removed connection is shown in FIG. 5 for attaching the triangles within a single module. Each of the triangle legs 130, 132 is provided with a splined portion 129, adapted to be grasped at a predetermined angular orientation, defined by the internal contour of connecting clip 127. Clip 127 has a pair of substantially circular bores having keyways aligned at the predetermined angular orientation, the keyways resiliently engaging the splined portion of the legs. As shown cut away and in section in FIG. **6*b*, legs 130 are maintained at the required alignment by the interaction of clip 127 and splined leg portion 129. A splined portion 129 is shown cut away in FIG. 6*a*. The use of splined shafts and the resultant secure orientation of attached triangles 142** make the modules of the building toy easy to construct, as well as structurally sound. It is presently preferred that additional strength be provided by use of solid plastic tubes and clips rather than hollow tubes.

Figure 7:
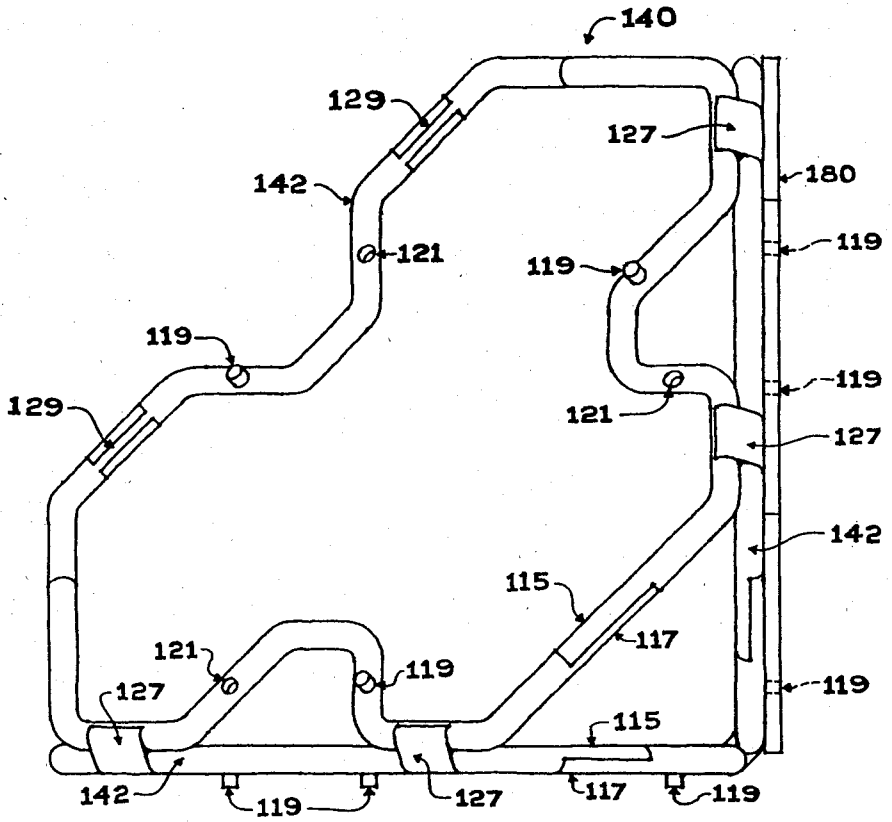
FIG. 7 is an elevation view of a module constructed according to FIG. 5.

FIG. 7 illustrates the connection of a module 140 to a panel member 180 by means of protrusions 119. Protrusions 119, extending from triangles 142, mate with appropriately positioned holes in panel 180. Panel 180 may be attached in this manner to any of the triangles.

Figure 8:
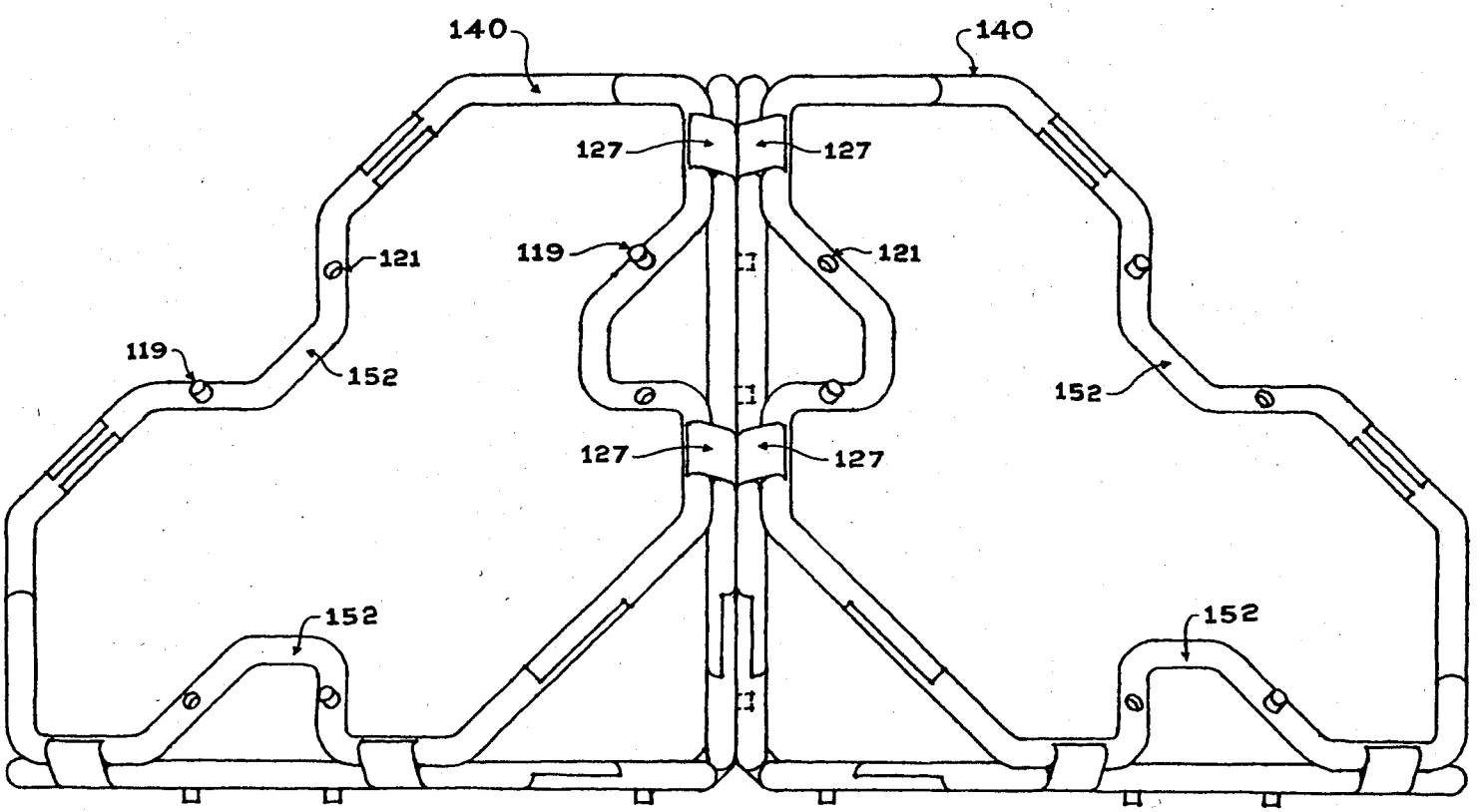
FIG. 8 is an elevation view of a two-module structure according to FIG. 5.

Module-to-module interconnection is shown in FIG. 8. Mating pins and receptacles in each triangular face are adapted to affix triangular faces in register, and thereby securely to attach neighboring modules 140. It will be noted that the area of attachment between modules 140 comprises a number of triangular legs in direct connection. Clips 127 connect the legs of triangles within the same module 140; protrusions 119 and receptacles 121 connect triangles between modules. The indentation portions 152, corresponding to the handholds and footrests 52 of the playground climbing equipment embodiment, are preferably included in the building block apparatus as well, for substantial additional visual variety as well as convenient means whereby the individual legs of the triangles, or the individual modules, can be grasped and manipulated.

The embodiments of the playground climbing equipment and the building toy have a number of features in common. Nevertheless, the embodiments both employ the feature of redundant use of tubes at connection points.

Unlike prior art devices in which support elements are disposed between vertices having means to anchor *one* such element for each required angle, the present invention employs transversely attached support elements for each triangle of each contiguous module.

Accordingly, when a plurality of modules are employed in a structure, as shown in FIG. 3, a plurality of supporting legs are necessarily employed as well. In this manner, a structure of virtually unlimited size is possible because, so long as a sufficient breadth of base is provided to make the overall structure stable against tipping over, there will be sufficient structural elements to carry and support the whole. Each module carries a full complement of structure elements. Larger structures having more modules therefore have proportionally more such structural elements.

It is presently preferred that playground climbing structures according to the invention be built from steel tubing of approximately twelve-gauge thickness. Of course, smaller and thinner tubing, or solid plastic or the like could be employed in small-scale structures. Solid plastic tubing is preferred in small-scale building toys, or alternatively, full triangular modules can be molded as a unit. With reference to the playground structures, the openings between the triangle legs must be large enough to allow relatively free passage of climbing children. A triangular opening of about two feet is sufficient to allow a child to crawl through with some clearance. In addition, substantial extra head space is preferred, for example by use of a three-foot clearance. According to the invention, the use of indentations 52 and their connection 56 permit the unit to be climbed easily even when the triangular openings are sufficiently large to allow a child to stand. The relative placement of the indentations around the triangles and the module likewise provides a very convenient and accessible point of contact for the climbing users.

A structure according to the invention may be combined with various other elements of playground equipment, including, for example, swings, sliding poles, sliding boards, nets, ropes, rope swings, bridges, tunnels, turrets, trapezes, and the like. Further alternatives will occur to skilled persons in light of this disclosure. Reference should be made to the appended claims rather than the foregoing specification as indicating the true scope of the invention.

What is claimed is:

1. A system of interconnectable building modules, each module comprising:

a triangular wall element having a base leg and two standing legs, the legs each defining a longitudinal axis, and the wall element defining a plane, the base leg and the standing legs being elongated members joinable at their ends to one another in an isosceles triangle having an angle of about fifty-five degrees between the longitudinal axis of said base leg and the longitudinal axes of each said standing leg and having an angle of about seventy degrees between the longitudinal axes of said two standing legs, the standing legs each having a connection hole oriented perpendicular to the respective longitudinal axes of the standing legs and oriented at 60 degrees to a plane defined by said isosceles triangle, and the base leg having a connection hole oriented perpendicular to the longitudinal axis of said base leg and oriented at forty-five degrees to said plane of said triangle, four said triangular wall elements forming a substantially tetrahedral building module when connected using coextensive connection holes, the four triangular wall elements being connected in a tetrahedron, said four wall elements defining a base plane, two sloping planes and a fourth plane perpendicular to said base plane, said elements, attached to one another along coextensive base legs, said base legs and said standing legs each further having at least one facewise-connecting hole oriented perpendicular to the respective longitudinal axis of said legs and perpendicular to the plane of said triangular element, whereby the triangular element is connectable in register directly to an additional triangular element placed thereupon, and whereby the tetrahedral building module can be attached to other tetrahedral building modules to form structures.

2. The system of claim 1, wherein a section of reduced cross-section protrudes from each leg at a first end thereof, and a complementary opening is formed in said leg at the opposite end thereof, said first end and said opposite end of each of the base leg and the standing legs being angularly displaced from the longitudinal axis of the leg to align the section of reduced cross-section of the leg and the opening of a contiguous leg, the base leg and the standing legs being connectable to one another by insertion of said sections of reduced cross-section into said openings.

3. The system of claim 2, wherein the section of reduced cross-section is swaged.

4. The system of claim 3, wherein the section of reduced cross-section is a separable dowel affixed in said first end.

5. The system of claim 1, further comprising indentations formed in each of said base leg and said standing legs, each indentation having an inwardly-directed "U" section formed at an intermediate area of said base leg and said standing legs of the triangular elements, and each indentation being directed toward an opposite leg of said triangular wall element, the connection holes being located outside the indentations and the facewise-connecting holes being located on the indentations.

6. The system of claim 5, wherein each of said indentations comprises a central segment substantially parallel to the longitudinal axis of a leg in which the indentation is formed and the central segment is attached to said leg by portions of the indentation attached to the central segment and aligned parallel to a contiguous one of the legs of the triangular wall elements, whereby a user climbing the module can step from the contiguous one of the legs to the portion of the indentation attached to the central segment, the contiguous one and the portion being parallel.

7. The system of claim 5, further comprising at least one flat panel dimensioned to fit over the triangular wall element and bridge at least two of said legs, the panel being affixed at said facewise-connecting holes.

8. The system of claim 7, wherein said panel is adapted to at least substantially close said triangular wall element.

9. The system of claim 8, wherein the panel is shaped to provide edges parallel to parts of the legs of the triangular wall elements.

10. The system of claim 1, wherein said base leg and standing legs are formed of metal tubes.

11. The system of claim 1, wherein the legs are solid plastic.

12. The system of claim 1, wherein said base leg and standing legs have parts bent toward one another at opposite ends thereof, the parts being connected end-to-end, and a first end and opposite end of each of said legs being aligned parallel to at least one other of said base legs and standing legs, forming a truncated tetrahedral module.

13. The system of claim 12, wherein said building module is also attachable to other identical building modules at truncated ends of the base leg and standing legs.

14. The system of claim 1, further comprising connection pins adapted to mate with said connection holes.

* * * * *